US005826152A

United States Patent [19]

Suzuki et al.

[11] Patent Number: 5,826,152

[45] Date of Patent: Oct. 20, 1998

[54] FIXING UNIT AND HEAT ROLLER FOR FIXING UNIT

[75] Inventors: Makoto Suzuki; Kazuhiko Takagi, both of Nagoya, Japan

[73] Assignee: Brother Kogyo Kabushiki Kaisha, Nagoya, Japan

[21] Appl. No.: 864,621

[22] Filed: May 28, 1997

[30] Foreign Application Priority Data

May 30, 1996 [JP] Japan ..... 8-136349

[51] Int. Cl.[6] ..... G03G 15/20

[52] U.S. Cl. ..... 399/330; 219/216; 219/469; 399/334

[58] Field of Search ..... 399/330, 328, 399/333, 334, 69; 219/216, 244, 469, 470, 539, 542, 543

[56] References Cited

U.S. PATENT DOCUMENTS

| | | | |
|---|---|---|---|
| 3,624,353 | 11/1971 | Bjorklund et al. | 219/470 |
| 4,801,968 | 1/1989 | Kogure et al. | 399/334 |
| 4,883,941 | 11/1989 | Martin et al. | 219/216 |
| 5,575,942 | 11/1996 | Watanabe | 319/469 |
| 5,666,627 | 9/1997 | Yamaguchi | 399/330 |

FOREIGN PATENT DOCUMENTS

| | | |
|---|---|---|
| A-62-279378 | 12/1987 | Japan . |
| 8-220908 | 8/1996 | Japan . |

*Primary Examiner*—Shuk Lee
*Assistant Examiner*—Sophia S. Chen
*Attorney, Agent, or Firm*—Oliff & Berridge, PLC

[57] ABSTRACT

A fixing unit for an image forming device such as a laser printer includes a heat roller and a heating member driving unit to drive the heat roller. The heat roller includes a hollow cylindrical tube and a resistance heating member to selectively heat portions of the tube along the axial length thereof. The resistance heating member includes an insulating layer and a conductive layer. The conductive layer is provided with a plurality of resistance heating patterns arranged along the axial length of the tube and connected to a plurality of electrode portions. The connections between the resistance heating patterns and the electrode portions are arranged such that applying a voltage across selected electrode portions causes selected resistance patterns to generate heat and thus, selectively heat a portion of the tube along the axial length thereof.

19 Claims, 7 Drawing Sheets

FIXING UNIT AND HEAT ROLLER FOR FIXING UNIT

BACKGROUND OF THE INVENTION

The present invention relates to a fixing unit and a heat roller for the fixing unit as used in an electrophotographic image forming process.

Conventional image forming devices, such as laser beam printers, copiers, and the like, employ an electrophotographic image forming process in which a toner image is electrophotographically transferred to a recording sheet, and then the toner image is fixed to the recording sheet at a fixing unit by applying heat to the recording sheet using a heat roller.

A conventional fixing unit includes a heat roller, a pressing roller biased towards the heat roller, a drive mechanism for rotating the heat roller and the pressing roller, and an electrical system for providing power to the heat roller so that the heat roller can generate heat.

The heat roller operates at a predetermined fixing temperature (e.g., 140° C.) and is provided with, for example, a resistance heating member to heat the heat roller to the predetermined fixing temperature. Conventionally, the resistance heating member is provided inside the heat roller and electrodes are provided so that a voltage can be applied to the resistance heating member to cause the resistance heating member to generate heat.

However, due to the position of the heat roller in the imaging forming device, the feeding of the paper, or the like, certain portions of the heat roller may overheat or cool more quickly than other portions of the heat roller causing an uneven temperature distribution along the axial direction of the heat roller. If portions of the heat roller overheat, elements of the image forming device that are made from synthetic resin or the like and that are located around the heat roller may be deformed, or, in the worst case, the elements or recording sheet may catch on fire. If portions of the heat roller are cooler than the required fixing temperature, the fixing process may not be properly performed, providing a lower quality image.

As an example, typically, axial end portions of the heat roller radiate heat more quickly than a central portion thereof. Thus, the temperature at the end portions tends to be lower than the temperature at the central portion. Thus, in order to obtain an even temperature distribution along the axial direction of the heat roller, it is necessary that the end portions be heated more than the central portion. This problem may be overcome by, for example, varying the thickness of the resistance heating member along the axis of the heat roller or using a different material for the resistance heating member at the end portions of the heat roller, however, such solutions complicate the manufacturing of the resistance heating member and thus may increase the manufacturing cost.

A second example of uneven temperature distribution occurs when a recording sheet having a smaller width is fed through the fixing unit. In this case, the portion of the heat roller that does not contact the recording sheet may overheat, since heat is not drawn away from this portion of the heat roller by the recording sheet. As mentioned above, overheating may harm the image forming device. This uneven temperature distribution cannot be as easily corrected by the methods discussed above for correcting uneven heat radiation at the axial ends of the heat roller.

Japan Patent Provisional Publication SHO 62-279378, discloses a fixing unit including a heat roller using a resistance heating member. The heat roller is provided, on an inner side thereof, with a resistance heating member that includes an insulating layer and a conductive layer. Further, the fixing unit includes a pair of circular electrodes, that contact the inner circumference of the resistance heating member, and an electrode drive mechanism for driving the electrodes along the axis of the heat roller. A controller controls the electrode drive mechanism to adjust the positions of the brush members along the axis of the heat roller such that electricity is passed only through a portion of the resistance heating member which is positioned between the brush members, corresponding to the width of the recording sheet.

However, the above arrangement, i.e., the use of the circular electrodes and an electrode drive mechanism to move the electrodes relative to the resistance heating member, involves a complicated and expensive driving and control system.

SUMMARY OF THE INVENTION

It is therefore an object of the present invention to provide an improved fixing unit and heat roller for fixing unit which allow easy adjustment of the temperature distribution along the axis of the heat roller.

According to one aspect of the invention there is provided a fixing unit that includes a base, a heat roller rotatably supported on the base, and a heating member driving unit electrically connected to the heat roller.

The heat roller includes a hollow cylindrical tube, an insulating layer affixed to an inner side of the tube, a plurality of electrode portions formed on the insulating layer extending around an inner circumference of the tube, a plurality of electrodes, corresponding to the plurality of electrode portions, fixed to the base and slidably contacting the corresponding plurality of electrode portions, and a plurality of resistance heating patterns formed on the insulating layer. The resistance heating patterns are arranged along an axial length of the tube and each of the resistance heating patterns is connected to predetermined electrode portions of the plurality of electrode portions.

The heating member driving unit selectively applies a voltage to the plurality of electrodes.

With this arrangement of the fixing unit, the plurality of resistance heating patterns can be selectively energized to heat only selected portions of the heat roller along the axial length thereof and both the problems of differing heat radiation levels and overheating of areas of the heat roller due to differing recording sheet widths can be compensated for by varying the amount of heating applied to different axial portions of the heat roller.

In a particular case, the heating member driving unit includes at least one voltage source, a plurality of switch circuits that connect the voltage source with at least a selected electrode of the plurality of electrodes, and a controller for controlling the plurality of switch circuits according to predetermined data.

The predetermined data may be, for example, representative of the size of a recording sheet or the like. In this way the controller may control the switches in order to control the heating of the heat roller according to the predetermined data.

In another particular case, each of the plurality of electrodes may include a support electrode extending from the base and a brush supported by the support electrode which slidably contacts the corresponding electrode portion. In this way, a circular electrode is not required.

The plurality of resistance heating patterns may be arranged according to the requirements of the fixing unit. For example, the plurality of resistance heating patterns may be arranged having substantially equal lengths along the axial length of the tube or may be arranged having different lengths along the axial length of the tube.

According to another aspect of the invention, there is provided a heat roller that includes a hollow cylindrical tube and a resistance heating member provided inside the tube for selectively heating selected axial lengths of the tube.

In particular, the resistance heating member includes an insulating layer, at least three electrode portions, and a plurality of resistance heating patterns. The at least three electrode portions are formed on said insulating layer to extend in a circumferential direction of said tube and the plurality of resistance heating patterns are formed on said insulating layer and arranged along an axial length of said tube. Further, the ends of each of said resistance heating patterns are connected to predetermined support electrodes of said at least three electrode portions.

With this arrangement, a voltage may be applied to a particular resistance heating pattern to heat only the portion of the heat roller near the particular resistance heating pattern. As above, both the problems of differing heat radiation levels and overheating of areas of the heat roller due to differing recording sheet widths can be compensated for by varying the amount of heating applied to different axial portions of the tube.

In this embodiment, the plurality of resistance heating patterns may be electrically connected in series, such that, by applying a voltage across all of the plurality of resistance heating patterns, the whole heat roller may be heated.

In a particular case, each consecutive resistance heating pattern is connected to each previous resistance heating pattern at a connecting portion and each of said connecting portions is connected to a corresponding one of said at least three electrode portions.

Further, if each of the connecting portions are electrically connected to a single electrode portion, the number of electrode portions required may be reduced.

As above, the plurality of resistance heating patterns may be arranged according to the requirements of the heat roller. For example, the plurality of resistance heating patterns may be arranged having substantially equal lengths along the axial length of the tube, having different lengths along the axial length of the tube, or symmetrically with respect to a center point along the axial length of the tube.

Preferably, the plurality of resistance patterns are formed as serpentine patterns to uniformly distribute heat over a predetermined area.

As a particular example, the tube may be formed of aluminum to provide good heat conduction, the insulating layer may be formed of resin to provide good heat conduction and sufficient electrical insulation, and the electrode portions and the resistance heating patterns may be formed of stainless steel to provide sufficient resistance heat formation.

Further preferably, the heat roller further includes a deposit prevention layer provided on an outer surface of the tube in order to prevent toner from adhering to the outer surface of the heat roller.

In a particular case, a dimension of the insulating layer corresponding to an inner circumference of the tube is slightly longer than a dimension of the inner circumference, such that, when the insulating layer is affixed to the tube, a top portion of the insulating layer overlaps a bottom portion of the insulating layer.

Since the insulation layer completely covers the inner surface of the tube, there is no danger that electrical brushes or connectors used for making electrical contact with the electrode portions will come in contact with the tube. Further, if the top portion is arranged to overlap on the bottom portion in a direction opposite to that in which the tube rotates during operation of the heat roller, there is less chance that the electrical brushes or connectors will be interfered with as the tube rotates. This arrangement further allows a connector to run through the bottom portion of the insulating layer to connect the resistance heating patterns to the electrode portions without interfering with the resistance heating patterns or the electrical brushes or connectors.

DETAILED DESCRIPTION OF THE PREFERRED EMBODIMENT

A fixing unit according to an embodiment of the invention is described as applied to an image forming device such as a copier, a printer, a facsimile device, or the like.

Figure 1:
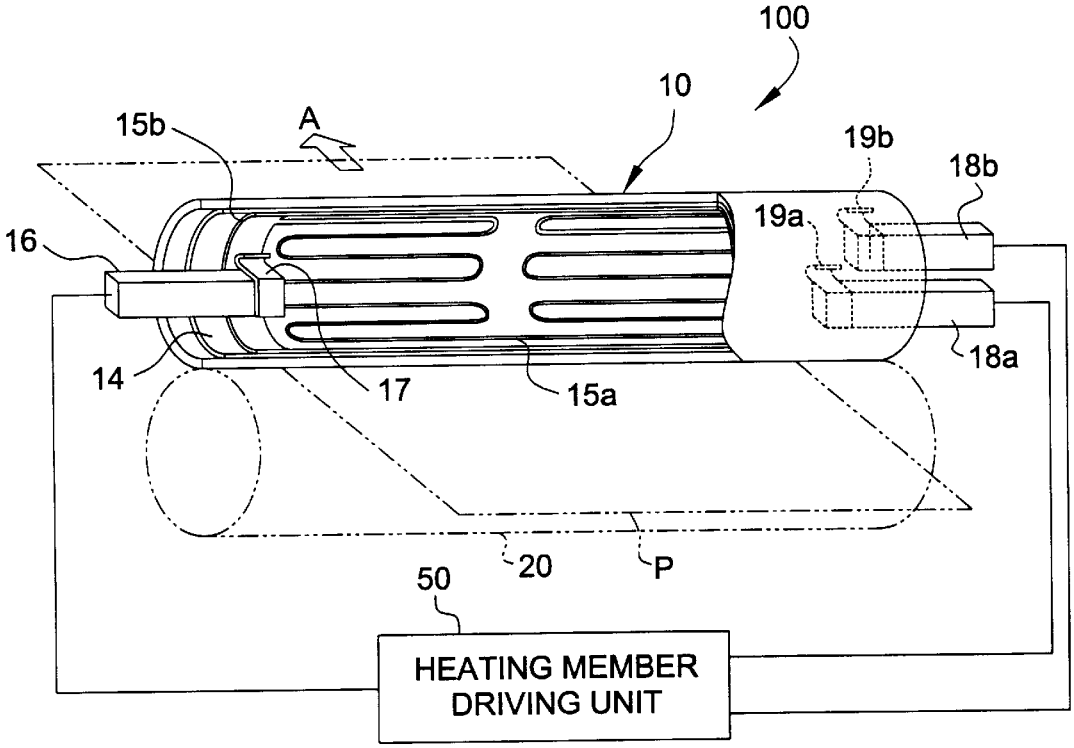
FIG. 1 is a schematic perspective view of a fixing unit according to a first embodiment of the invention.

FIG. 1 is a schematic perspective view of a fixing unit 100 according to an embodiment of the invention. The fixing unit 100 includes a base (not shown), a heat roller 10, a pressing roller 20, and a heating member driving unit 50.

The heat roller 10 and the pressing roller 20 are rotatably supported by the base such that the heat roller 10 and the pressing roller 20 are biased towards each other. In operation, the heat roller 10 is heated and the heat roller 10 and the pressing roller 20 are rotated to feed a recording sheet P, bearing an unfixed toner image, between the heat roller 10 and the pressing roller 20 in the direction indicated by an arrow A in FIG. 1. As the recording sheet P is fed, the toner image on the recording sheet P is fixed onto the recording sheet P by heat from the heat roller 10.

Figure 2:
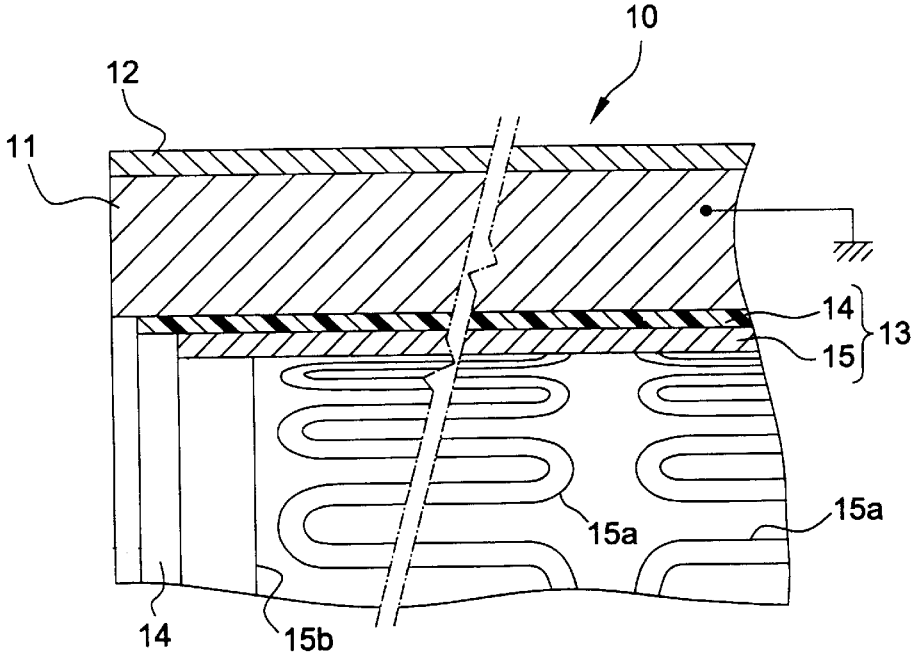
FIG. 2 is an enlarged partial sectional view of a heat roller of the fixing unit of FIG. 1.

As shown in the enlarged sectional view of FIG. 2, the heat roller 10 includes a roller body 11, a deposit prevention layer 12 and a resistance heating member 13.

The roller body 11 is formed as a hollow cylindrical tube made of a material having excellent heat conductivity, such as aluminum or the like.

The deposit prevention layer 12 is formed on an outer surface of the roller body 11 in order to prevent toner from adhering to the heat roller 10. In particular, the deposit prevention layer 12 may have a thickness of approximately 10 to 20 μm, and is preferably formed from a material having excellent heat resistance, such as a fluoride resin (e.g., a fluoride resin sold under the Trademark "TEFLON", or the like.

The resistance heating member 13 is provided on an inner surface of the roller body 11. The resistance heating member 13 includes a flexible insulating layer 14 and a flexible conductive layer 15. The insulating layer 14 may be made from, for example, a polyimide resin having a thickness of 30 to 50 μm. The conductive layer 15 may be formed as, for example, a stainless steel foil having a thickness of 30 to 50 μm adhered to the insulating layer 14. Further, the conductive layer 15 is formed having a predetermined pattern as described with reference to FIG. 3.

Figure 3:
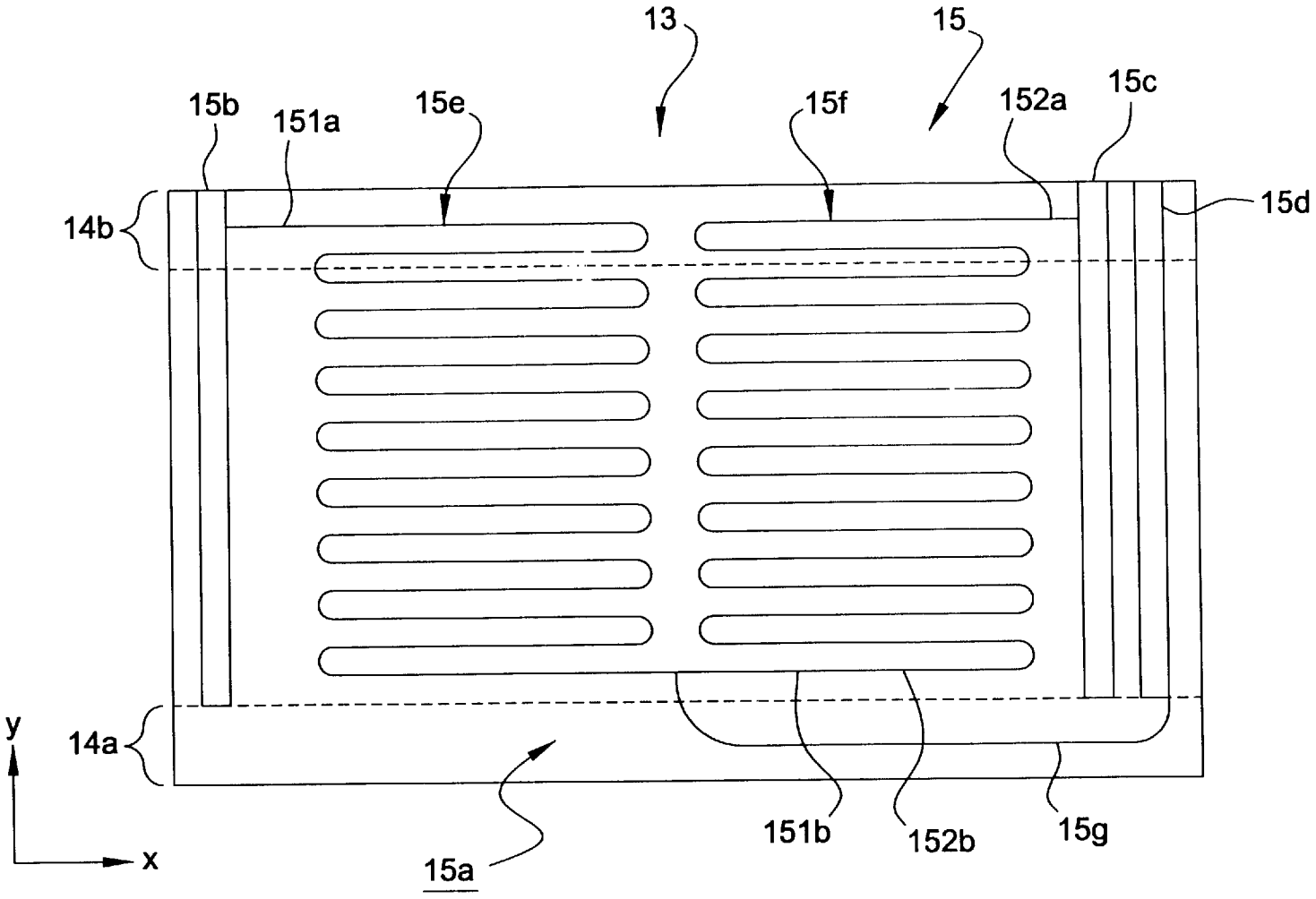
FIG. 3 is a developed view of a resistance heating member of the heat roller.
Figure 4:
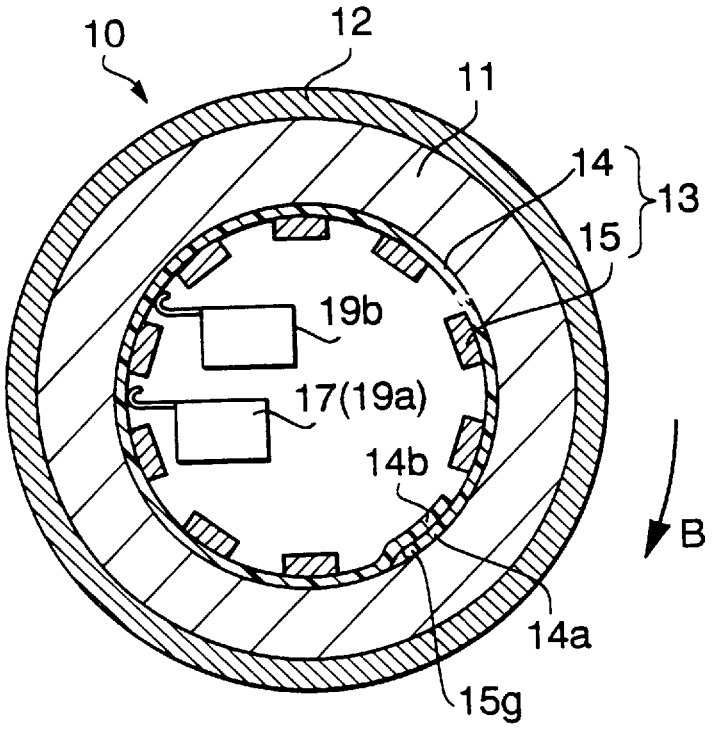
FIG. 4 is a sectional side view of the heat roller of FIG. 1.

FIG. 3 is a developed view of the resistance heating member 13 showing the insulating layer 14 and the conductive layer 15. The axial direction of the heat roller 10 is indicated as an X direction and the inner circumference direction of the heat roller 10 is indicated as a Y direction. FIG. 4 is a side sectional view of the heat roller 10 with the resistance heating member 13 installed therein. In FIG. 4, the dimensions of the deposit prevention layer 12, the insulating layer 14, and the conductive layer 15 are exaggerated for clarity.

As shown in FIGS. 3 and 4, the insulating layer 14 is longer in the Y direction that the inner circumference of the roller body 11, such that, when the resistance heating member 13 is installed in the roller body 11, a top area 14*b* will overlap and cover a bottom area 14*a*.

As shown in FIG. 3, the conductive layer 15 includes a resistance heating portion 15*a*, and first, second, and third electrode portions 15*b*, 15*c*, and 15*d*.

The first electrode portion 15*b* and the second and third electrode portions 15*c* and 15*d* are formed at opposite ends of the insulating layer 14 (i.e., the right and left sides of FIG. 3) extending in the Y direction but not entering on the bottom area 14*a*. The third electrode portion 15*d* is formed closer to the end of the insulating layer than the second electrode portion 15*c*, i.e., to the right of the second electrode portion 15*c* in the view of FIG. 3.

The resistance heating portion 15*a* includes first and second resistance heating patterns, referred to as first and second serpentine patterns 15*e* and 15*f*, each arranged over approximately half the X direction of the insulating layer 14 and over all of the Y direction of the insulating layer 14 except the bottom area 14*a*, i.e., the first serpentine pattern 15*e* is arranged on the left half of the insulating layer 14 and the second serpentine pattern 15*f* is arranged on the right half of the insulating layer 14, as shown in the view of FIG. 3. The first serpentine portion 15*e* includes first and second end portions 151*a* and 151*b* and, similarly, the second serpentine portion 15*f* includes first and second end portions 152*a* and 152*b*.

The second end portions 151*b* and 152*b* of the first and second serpentine patterns 15*e* and 15*f* are electrically connected together near the bottom area 14*a*. An electrical connector 15*g* is connected at the connection of the second end portions 151*b* and 152*b*, runs along the bottom area 14*a*, and is connected to the third electrode portion 15*d*. Further, the first end portion 151*a* of the first serpentine pattern 15*e* is electrically connected to the first electrode portion 15*b* in the top area 14*b* and the first end portion 152*a* of the second serpentine pattern 15*f* is electrically connected to the second electrode portion 15*c* in the top area 14*b*.

Thus, if a voltage is applied across the first electrode portion 15*b* and the second electrode portion 15*c*, current flows through both the first and second serpentine patterns 15*e* and 15*f*, since the first and second serpentine patterns 15*e* and 15*f* are connected in series. If a voltage is applied across the first electrode portion 15*b* and the third electrode portion 15*d*, current flows only in the first serpentine pattern 15*e*. Similarly, if a voltage is applied across the second electrode portion 15*c* and the third electrode portion 15*d*, electric current flows only in the second serpentine pattern 15*f*.

The resistance heating member 13 may be formed by, first, bonding a conductive material, for example, a metal foil (stainless steel, copper foil, or the like), onto the insulating layer 14, and then, screen printing a resist (not shown), corresponding to the resistance heating portion 15*a* and the first, second, and third electrode portions 15*b*, 15*c*, and 15*d*, onto the conductive material, and finally, performing an etching process to remove the resist and leave only the resistance heating portion 15*a* and the first, second, and third electrode portions 15*b*, 15*c*, and 15*d* of the conductive layer 15.

The resistance heating member 13 is then placed inside the roller body 11 and secured with an adhesive or the like. The insulating layer is secured such that the conductive layer 15 is facing the axis of the roller body 11, and the first, second, and third electrode portions 15*b*, 15*c*, and 15*d* form continuous tracks around the inner circumference of the heat roller 10. In this embodiment, since the first, second, and third electrode portions 15*b*, 15*c*, and 15*d* are provided at the end portions of the resistance heating member 13, it is unnecessary to provide separate circular electrodes to contact the inner circumference of the heat roller 10.

In this case, referring again to FIG. 1, the heat roller 10 is provided with first, second, and third support electrodes 16, 18*a* and 18*b*. The first, second, and third support electrodes 16, 18*a* and 18*b* are provided with first, second, and third brushes 17, 19*a* and 19*b* at the tips thereof and are arranged such that the first, second, and third brushes 17, 19*a*, and 19*b* contact the first, second, and third electrode portions 15*b*, 15*c*, and 15*d*, respectively. As the heat roller 10 rotates the first, second, and third brushes 17, 19*a*, and 19*b* remain in sliding contact with the corresponding first, second, and third electrode portions 15*b*, 15*c*, and 15*d*.

As described above and as shown in FIG. 4, when the resistance heating member 13 is installed in the roller body 11, the top area 14*b* overlaps and covers the bottom area 14*a*. Thus, the insulating film 14 covers all of the inner circumference of the roller body 11 and the brushes 17, 19*a* and 19*b* do not contact the roller body 11 directly. Further, the bottom and top areas 14*a* and 14*b* are arranged to overlap in relation to the rotational direction (indicated by an arrow B in FIG. 4) of the heat roller 10 so that the brushes 17, 19*a*, 19*b* do not catch on the insulating film 14 and thereby, the life of the brushes 17, 19*a*, 19*b* and the insulating film 14 is extended.

Further, as shown in FIG. 3, the provision of the bottom area 14*a* allows the connector 15*g* to connect the third electrode portion 15*d* and the resistance heating portion 15*a* through the bottom area 14*a* (insulated by the top area 14*b*) to ensure that the first, second, and third brushes 17, 19*a* and 19*b* do not accidentally make contact with an incorrect part of the conductive layer 15.

Figure 7:
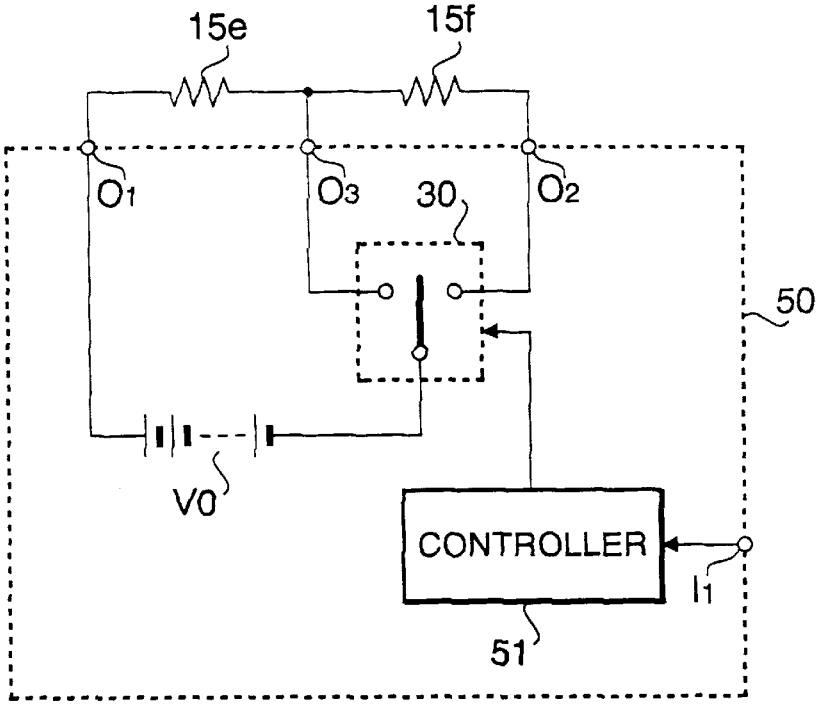
FIG. 7 is a schematic diagram of an electrical system for the fixing unit according to the first embodiment.

The operation of the heat roller 10 is now described. FIG. 7 is a simplified schematic diagram of the heating member driving unit 50 and the heat roller 10. The heating member driving unit 50 includes a controller 51, a switch circuit 30, a voltage source V0, an input port I1, and three output ports O1, O2, O3. In a particular case, the controller 51 and the voltage source V0 may be shared elements with related elements in the image forming device.

The controller 51 receives data regarding paper size and the like from the image forming device (for example, from an operation panel (not shown) of the image forming device) via input port I1 and controls the switch circuit 30 according to the data received.

The voltage source V0 is electrically connected to the output port O1 and to the switch circuit 30. The switch circuit 30, as controlled by the controller 51, electrically connects the voltage source V0 to either the output port O2 or the output port O3. The output ports O1, O2, and O3 are connected to the first, second, and third support electrodes 16, 18*a,* and 18*b,* respectively.

Thus, the controller 51 controls the switch circuit 30 to apply a voltage from the voltage source V0 across the first support electrode 16 and a selected one of the second and third support electrodes 18*a* and 18*b.*

In particular, if the switch circuit 30 is set for the output O2, a voltage is applied across the first and second electrode portions 15*b* and 15*c* and heat is generated by both serpentine patterns 15*e* and 15*f* along the entire length of the heat roller 10. If the switch circuit 30 is set for the output O3, a voltage is applied across the first and third electrode portions 15*b* and 15*d* and only the first serpentine pattern 15*e* generates heat such that only a corresponding portion of the heat roller 10 is heated.

Figure 8:
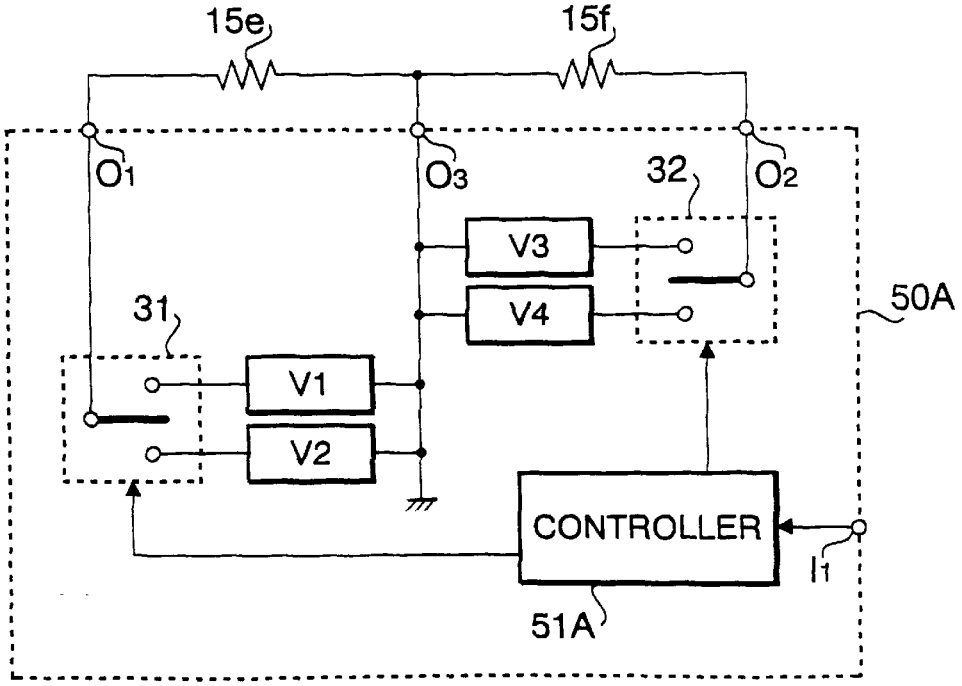
FIG. 8 is a schematic diagram of an alternative electrical system for the fixing unit according to the first embodiment.

An alternative heating member driving unit 50A is shown in FIG. 8 as attached to the heat roller 10. The alternative heating member driving unit 50A is similar to the heating member driving unit 50 described above and identical elements are assigned the same reference numbers. The heat member driving unit 50A includes the input port I1, the output ports O1, O2, O3, a controller 51A, two switch circuits 31, 32, and four voltage sources V1, V2, V3, V4.

The switch circuit 31 is controlled by the controller 51A to connect the output port O2 to either of voltage source V1 or voltage source V2 and the switch circuit 32 is controlled by the controller 51A to connect the output port O1 to either of voltage source V3 or voltage source V4. The output port O3 and the voltage sources V1, V2, V3, V4 are connected to ground.

As above, the output ports O1, O2, and O3 are connected to the first, second, and third support electrodes 16, 18*a,* and 18*b,* respectively, and the controller 51A receives data through the input port I1.

Thus, the controller 51A controls the switch circuits 31, 32 to selectively apply a voltage from either voltage source V1 or V2 to the first support electrode 16, and selectively apply a voltage from either voltage source V3 or V4 to the second support electrode 18*a.* Thus, a voltage applied to each of the serpentine patterns 15*e* and 15*f* can be varied.

As an example, if the switch circuit 31 is set for the voltage source V1, a predetermined voltage is applied to the second serpentine pattern 15*f* and the second serpentine pattern generates a predetermined amount of heat, whereas if the switch circuit 31 is set for the voltage source V2, a different predetermined voltage is applied to the second serpentine pattern 15*f* and a different predetermined amount of heat is generated. The voltage applied to the first serpentine portion 15*e* is similarly controlled. Thus, corresponding portions of the heat roller 10 are heated according to the voltage applied to the first and second serpentine portions 15*e* and 15*f.*

Figure 5:
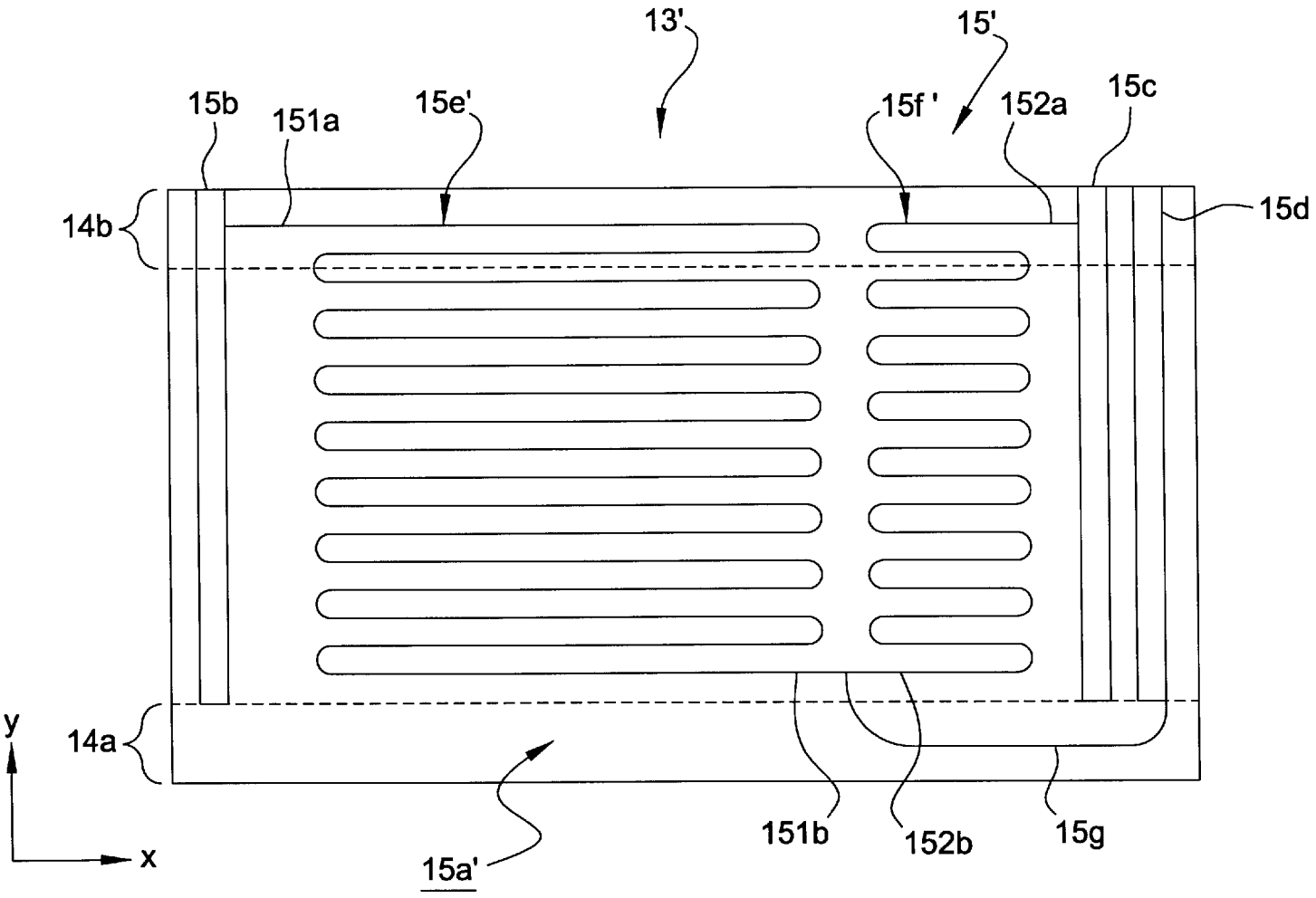
FIG. 5 is a developed view of an alternative resistance heating member.

As a further alternative of the first embodiment, an alternative resistance heating member 13' is shown in FIG. 5. The resistance heating member 13' is similar to the resistance heating member 13 described above except that the proportions of the first and second serpentine portions 15*e'* and 15*f'* of resistance heating portion 15*a'* on conductive layer 15' are arranged such that the first serpentine portion 15*e'* covers approximately three-quarters of the insulating layer 14 and the second serpentine portion 15*f'* covers the remaining part of the insulating layer 14. This arrangement may be useful in an image forming device in which an edge of the recording sheet P is generally aligned near an end of the heat roller 10. It should be noted that either of the heating member driving units 50, 50A described above may be used with the alternative resistance heating member 13'.

A resistive heating member 213 according to a second embodiment of the invention is now described with reference to FIG. 6. Note, elements in this embodiment that are identical to elements in the previous embodiment are assigned the same reference numerals and the description thereof is omitted.

Figure 6:
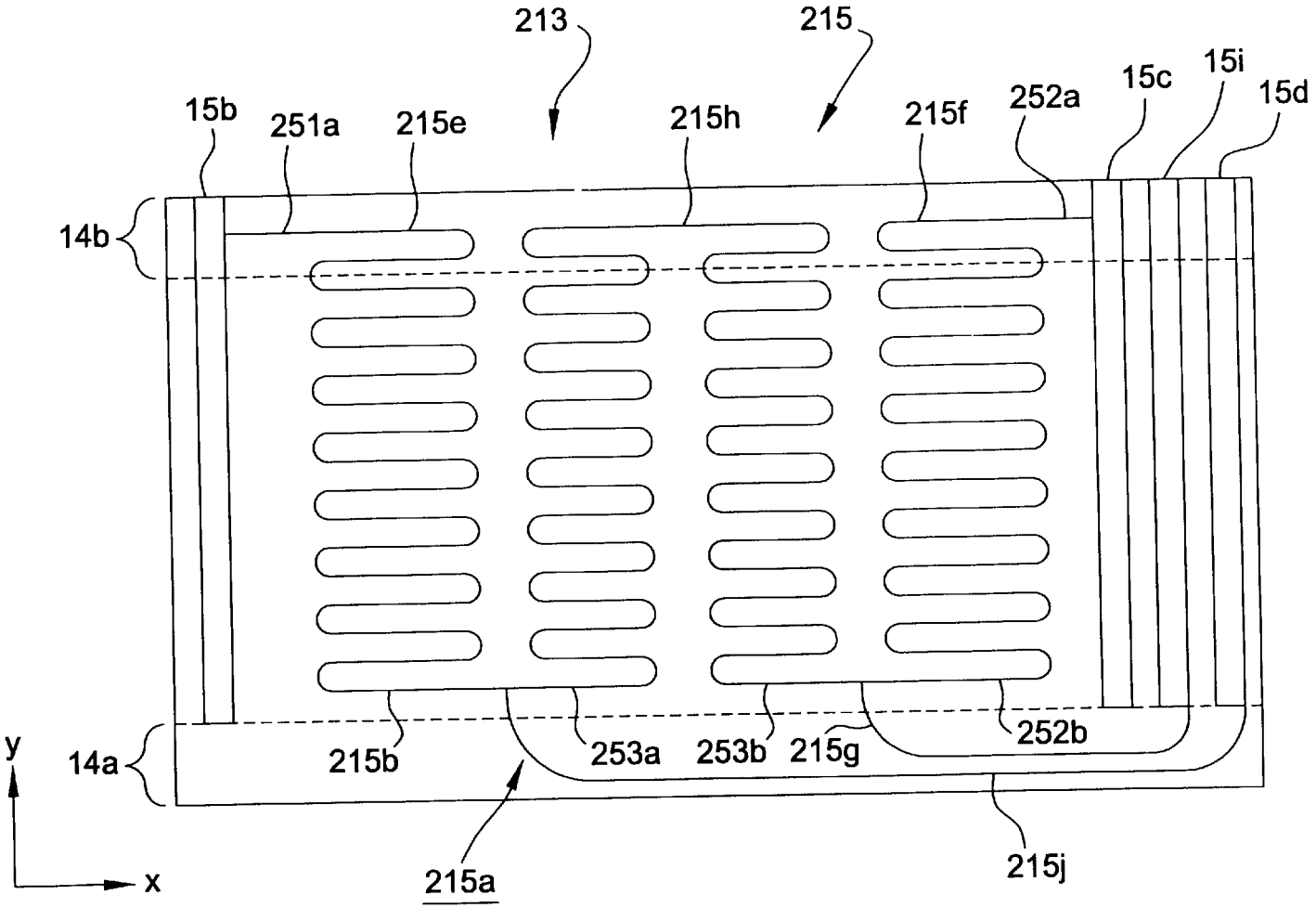
FIG. 6 is a developed view of a resistance heating member according to a second embodiment of the invention.

As shown in FIG. 6, the insulating layer 14 is provided with a conductive layer 215 that includes the first, second, and third electrode portions 15*b,* 15*c,* and 15*d* of the first embodiment. In this embodiment, the conductive layer 215 is further provided with a fourth electrode portion 215*i,* positioned outside of the third electrode portion 15*d,* i.e., at the right side in FIG. 6. Also, rather than the resistance heating portion 15*a* of the previous embodiment, the conductive layer 215 includes a resistance heating portion 215*a.*

The resistance heating portion 215*a* includes first, second, and third resistance heating patterns, referred to as first, second, and third serpentine patterns 215*e,* 215*f,* and 215*h,* each arranged over a predetermined area along the X direction of the insulating layer 14 and over all of the Y direction of the insulating layer 14 except the bottom area 14*a.* In particular, along the X direction, the first serpentine pattern 215*e* is arranged on approximately a left quarter of the insulating layer 14, the second serpentine pattern 15*f* is arranged on approximately a right quarter of the insulating layer 14, and the third serpentine pattern 15*h* is arranged between the first and second serpentine patterns 15*e* and 15*f,* as shown in the view of FIG. 6. The first serpentine portion 215*e* includes first and second end portions 251*a* and 251*b,* the second serpentine portion 215*f* includes first and second end portions 252*a* and 252*b,* and, similarly, the third serpentine portion 215*h* includes first and second end portions 253*a* and 253*b.*

The second end portion 251*b* of the first serpentine pattern 215*e* and the first end portion 253*a* of the third serpentine pattern 215*h* are connected near the bottom area 14*a.* An electrical connector 215*j* is connected at the connection of the end portions 251*b* and 253*a,* runs along the bottom area 14*a,* and is connected to the third electrode portion 15*d.*

Similarly, the second end portion 252*b* of the second serpentine pattern 215*f* is connected with the first end portion 253*b* of the third serpentine pattern 215*h* near the bottom area 14*a* and an electrical connector 215*g* is connected at the connection of the end portions 252*b* and 253*b,* runs along the bottom area 14*a,* and is connected to the fourth electrode portion 15*i.*

Further, the first end portion 251*a* of the first serpentine pattern 215*e* is electrically connected to the first electrode portion 15*b* in the top area 14*b* and the first end portion 252*a* of the second serpentine pattern 215*f* is electrically connected to the second electrode portion 15*c* in the top area 14*b.*

Thus, if a voltage is applied across the first electrode portion 15*b* and the second electrode portion 15*c,* current flows through all of the first, second, and third serpentine patterns 215*e,* 215*f,* and 215*h,* since the first, second, and third serpentine portions 215*e,* 215*f,* and 215*h* are connected in series. If a voltage is applied across the first electrode portion 15*b* and the third electrode portion 15*d,* current flows in the first and third serpentine patterns 215*e* and 215*h.* If a voltage is applied across the second electrode portion 15*c* and the third electrode portion 15*d,* current flows only in the second serpentine pattern 215*f.* If a voltage is applied across the fourth electrode portion 15*i* and the third electrode portion 15*d,* current flows only in the third serpentine pattern 215*h.*

Figure 9:
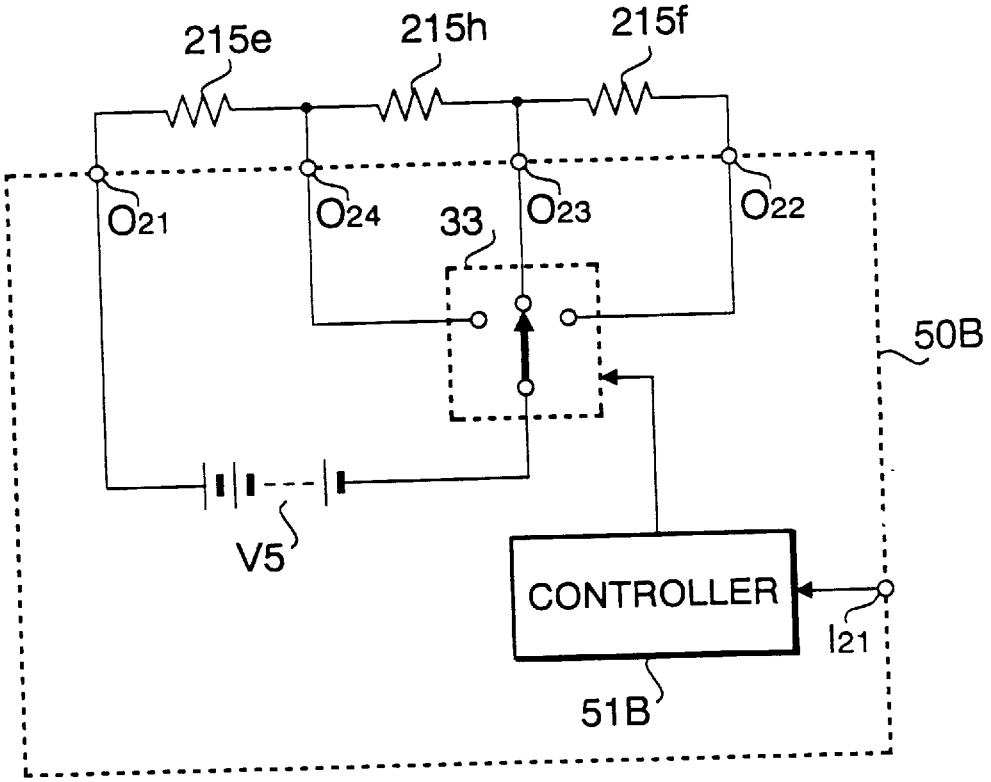
FIG. 9 is a schematic diagram of an electrical system for the fixing unit according to the second embodiment.

In this embodiment, a fourth support electrode and brush (not shown) are provided to contact the fourth electrode portion 15*i.* FIG. 9 shows an arrangement of a heating member driving unit 50B for this embodiment. The heating member driving unit 50B includes a controller 51B, a switch circuit 33, a voltage source V5, an input port I21, and four output ports O21, O22, O23, and O24. In a particular case, the controller 51B and the voltage source V5 may be shared elements with related elements in the image forming device.

The controller 51B receives data regarding recording sheet size and the like from the image forming device (for example, from an operation panel (not shown) of the image forming device) via input port 121 and controls the switch circuit 33 according to the data received.

The voltage source V5 is electrically connected to the output port O21 and to the switch circuit 33. The switch circuit 33 electrically connects the voltage source V5 to one of the output ports O22, O23, or O24. The output ports O21, O22, O23, and O24 are connected to the first, second, third support electrodes 16, 18*a,* 18*b* and the fourth support electrode (not shown), respectively.

Thus, the controller 51B controls the switch circuit 33 to selectively apply a voltage from the voltage source V5 across the first support electrode 16 and a selected one of the second, third, and fourth support electrodes 18*a,* 18*b* such that current flows through selected serpentine patterns 215*e,* 215*f,* 215*h* of the resistance heating portion 215*a.*

For example, if the switch circuit 33 is set for the output O22, a voltage is supplied across the first and second electrode portions 15*b* and 15*c,* current flows through the first, second, and third serpentine patterns 215*e,* 215*f,* and 215*h,* and heat is generated along the entire length of the heat roller 10. If the switch circuit 33 is set for the output O23, a voltage is supplied across the first and third electrode portions 15*b* and 15*d,* and only the first and third serpentine patterns 215*e* and 215*h* generate heat. Further, if the switch circuit 33 is set for the output O24, only the first serpentine pattern 15*e* generates heat and only a corresponding portion of the heat roller 10 is heated.

Note that by using alternative arrangements of the heating member driving unit 50B, similar to the alternative described above, voltages may be applied in other combinations or at varying levels to obtain a desired heating pattern.

Thus, with the arrangements described above, portions of the heat roller along the axis thereof may be selectively heated in order to provide a uniform temperature for fixing toner on the recording sheet while avoiding the problems of overheating or cooling. For example, even if a recording sheet having a small width is fed to the heat roller, the portion of the heat roller which does not contact the recording sheet can be prevented from overheating and an even distribution of heat may be maintained using an appropriate amount of power.

Although the structure and operation of a fixing unit and a heat roller for fixing unit are described herein with respect to the preferred embodiments, many modifications and changes can be made without departing from the spirit and scope of the invention.

For example, rather than using stainless steel for the conductive layer, another metal such as copper or iron may be used. In the case that copper foil is used, there is an advantage in that copper may be soldered easily, however, since copper has less resistance than stainless steel, the resistance heating portion 15*a* must be made thinner and longer than that for stainless steel. Further, since the copper oxidizes easier than stainless steel, if copper foil is used, it is preferable to cover the resistance heating portion 15*a* with a film made of polyimide resin or the like.

As another example modification, the conductive member 15 may be modified to include more than the described number of serpentine patterns or electrode portions. Further, the serpentine patterns may be formed having different widths. Further modifications may depend on the selection of appropriate materials and patterns depending on factors such as the type of image forming device, and the like.

Still further, the insulating sheet 14 may be secured on the roller body 11 by a method other than adhesion.

Still further, the voltage sources V0, V1, V2, V3, V4, V5, and switch circuits 30, 31, 32, 33 may be replaced by equivalent circuit elements. In particular, the voltage sources V0, V1, V2, V3, V4, V5 may be replaced by current sources. Further, the switch circuits 30, 31, 32, 33 may be controlled manually rather than by a controller.

The present disclosure relates to subject matter contained in Japanese Patent Application No. HEI 08-136349, filed on May 30, 1996, which is expressly incorporated herein by reference in its entirety.

What is claimed is:

1. A fixing unit comprising:

a base;

a heat roller rotatably supported on said base, said heat roller comprising:

a hollow cylindrical tube;

an insulating layer affixed to an inner side of said tube;

a plurality of electrode portions formed on said insulating layer extending around an inner circumference of said tube;

a plurality of electrodes, corresponding to said plurality of electrode portions, fixed to said base and slidably contacting said corresponding plurality of electrode portions; and a plurality of resistance heating patterns formed on said insulating layer, arranged along an axial length of said tube, each of said resistance heating patterns connected to predetermined electrode portions of said plurality of electrode portions and said plurality of resistance heating patterns being electrically connected in series; and a heating member driving unit for selectively applying a voltage to said plurality of electrodes.

2. The fixing unit according to claim 1, said heating member driving unit comprising:

at least one voltage source;

a plurality of switch circuits connecting said at least one voltage source and at least a selected electrode of said plurality of electrodes; and a controller for controlling said plurality of switch circuits according to predetermined data.

3. The fixing unit according to claim 1, each of said plurality of electrodes comprising:

a support electrode extending from said base; and a brush supported by said support electrode which slidably contacts a corresponding electrode portion.

4. The fixing unit according to claim 1, said plurality of resistance heating patterns arranged having substantially equal lengths along said axial length of said tube.

5. The fixing unit according to claim 1, said plurality of resistance heating patterns arranged having different lengths along said axial length of said tube.

6. A heat roller comprising:

a hollow cylindrical tube; and a resistance heating member provided inside said tube, said resistance heating member comprising:

an insulating layer affixed to said tube;

at least three electrode portions formed on said insulating layer to extend in a circumferential direction of said tube; and a plurality of resistance heating patterns formed on said insulating layer and arranged along an axial length of said tube, each of said resistance heating patterns electrically connected to predetermined electrode portions of said at least three electrode portions and said plurality of resistance heating patterns being electrically connected in series.

7. The heat roller according to claim 6, wherein each consecutive resistance heating pattern is connected to each previous resistance heating pattern at a connecting portion and each of said connecting portions is connected to predetermined electrode portions of said at least three electrode portions.

8. The heat roller according to claim 7, wherein each of said connecting portions is electrically connected to a single electrode portion.

9. The heat roller according to claim 8, said plurality of resistance heating patterns arranged having substantially equal lengths along said axial length of said tube.

10. The heat roller according to claim 8, said plurality of resistance heating patterns arranged having different lengths along said axial length of said tube.

11. The heat roller according to claim 8, said plurality of resistance heating patterns arranged along said axial length of said tube symmetrically with respect to a center point along said axial length of said tube.

12. The heat roller according to claim 8, said plurality of resistance heating patterns comprising first and second resistance heating patterns, and said at least three electrode portions comprising first, second, and third electrode portions, said first resistance heating pattern electrically connected with said first electrode portion, said second resistance heating pattern electrically connected with said second electrode portion, and a connecting portion connecting said first resistance heating pattern and said second resistance heating pattern being electrically connected with said third electrode portion.

13. The heat roller according to claim 8, said plurality of resistance heating patterns comprising first, second and third resistance heating patterns and said at least three electrode portions comprising first, second, third and fourth electrode portions, said first resistance heating pattern electrically connected with said first electrode portion, said third resistance heating pattern electrically connected with said second electrode portion, a first connecting portion electrically connected with said third electrode portion, and a second connecting portion electrically connected with said third electrode portion.

14. The heat roller according to claim 6, wherein said plurality of resistance patterns are formed as serpentine patterns to uniformly distribute heat over a predetermined area.

15. The heat roller according to claim 6, said tube formed of aluminum, said insulating layer formed of resin, and said at least three electrode portions and said resistance heating patterns formed of stainless steel.

16. The heat roller according to claim 6, wherein a dimension of said insulating layer corresponding to an inner circumference of said tube is slightly longer than a dimension of said inner circumference, such that, when said insulating layer is affixed to said tube, a top portion of said insulating layer overlaps a bottom portion of said insulating layer.

17. The heat roller according to claim 16, wherein said top portion overlaps on said bottom portion in a direction opposite to that in which said tube rotates during operation of said heat roller.

18. The heat roller according to claim 17, further including at least one connector running through said bottom portion to connect said plurality of resistance heating patterns with said at least three electrode portions.

19. The heat roller according to claim 6, further comprising a deposit prevention layer provided on an outer surface of said tube.

* * * * *